United States Patent [19]

Torii

[11] 4,365,651

[45] Dec. 28, 1982

[54] SHUTTLE UTILIZED FOR A CIRCULAR LOOM

[75] Inventor: Soichi Torii, Kyoto, Japan

[73] Assignee: Torii Winding Machine Co., Ltd., Kyoto, Japan

[21] Appl. No.: 201,383

[22] PCT Filed: Nov. 28, 1979

[86] PCT No.: PCT/JP79/00303

§ 371 Date: Jul. 23, 1980

§ 102(e) Date: Jul. 23, 1980

[87] PCT Pub. No.: WO80/01174

PCT Pub. Date: Jun. 12, 1980

[30] Foreign Application Priority Data

Nov. 29, 1978 [JP] Japan ..... 53-165441[U]
Nov. 29, 1978 [JP] Japan ..... 53-165442[U]

[51] Int. Cl.[3] ..... D03D 37/00
[52] U.S. Cl. ..... 139/13 A
[58] Field of Search ..... 139/13 R, 13.1, 16

[56] References Cited

U.S. PATENT DOCUMENTS

| | | | |
|---|---|---|---|
| 1,357,969 | 11/1920 | Pray | 139/13 R |
| 2,168,385 | 8/1939 | Baumgartner | 139/13 R |
| 2,321,283 | 6/1943 | Ghetto | 139/13 R |
| 3,871,413 | 3/1975 | Torii | 139/13 R |

FOREIGN PATENT DOCUMENTS 38-160207 7/1943 Japan .

*Primary Examiner*—Henry Jaudon
*Attorney, Agent, or Firm*—Burgess, Ryan and Wayne

[57] ABSTRACT

A shuttle utilized for producing a tubular fabric by a circular loom. The shuttle is provided with an improved structure for easily mounting on or dismounting from said circular loom. This shuttle is further provided with a plurality of guide wheels which ensure stable supporting said shuttle while driving along a guide means of said circular loom by a shuttle propelling mechanism.

6, Claims, 9 Drawing Figures

SHUTTLE UTILIZED FOR A CIRCULAR LOOM

DESCRIPTION

BACKGROUND OF THE INVENTION

This invention relates to an improved shuttle utilized for a circular loom.

DESCRIPTION OF THE PRIOR ART

Recently, a circular loom has been recognized as one of the most practical weaving machines for producing so-called tubular fabric, which is preferably used as a material-fabric for making a transportation container or a storage container of granules, such as grains, sugar fertilizers and synthetic resin pelletes. As a practical circular loom, the circular loom disclosed in U.S. Pat. No. 3,871,413 or a circular loom which has been manufactured and sold by the British Company, Fairbairn Lawson Machinery, Ltd. are well known.

In the above mentioned known circular looms, an even number of shuttles are mounted on an annular shuttle guide member so that they can travel along this guide member, and engaging means to be engaged with corresponding shuttles, respectively, such as press rollers, are moved along the shuttle guide member. Each shuttle is pressed by the corresponding engaging means and is propelled along the shuttle guide member. Wefts taken out from the respective shuttles are fabricated with warps sequentially opened on both the upper and lower sides of the respective shuttles by healds, and a tubular fabric is thus formed.

In the circular loom, for an increase in the production-efficiency, it is required to use so-called large-package-bobbins. However, since it is obvious that, if the size of the yarn package becomes larger, the size of the shuttle becomes larger and the force of gravity and the centrifugal force of the shuttle become larger in operation, stable support of a large shuttle on the annular shuttle guide member while the shuttle is travelling around the above mentioned shuttle guide member is required.

According to the experience of the inventors of the present invention, the shuttles utilized for the above-mentioned circular looms are not stably supported to the extent required for smooth operation and do not eliminate the trouble involved in the manual shuttle setting operation.

SUMMARY OF THE INVENTION

It is a primary object of the present invention to provide a shuttle having a mechanism for stably supporting the shuttle on the circular loom. It is another object of the present invention to provide a shuttle which can be easily handled manually at the time of shuttle setting operation.

In accordance with the present invention, each shuttle is mounted on a circular loom in such a way that a shuttle is mounted at a position between an annular guide member and an inside annular guide way, which are arranged concentrically with each other, and guide elements are capable of smoothly contacting with the annular guide member and inside annular guide way, respectively. In this shuttle, a main body of the shuttle is provided with a pair of brackets for rotatably supporting a bobbin and a lever pivotably mounted on the main body. One of the above-mentioned guide elements, which is capable of rotatably contacting the inside annular guide way, is rotatably mounted on a free end portion of the lever. One of the ends of a connecting lever is pivoted on the main body and the other end thereof is turnably connected to the lever by a pin. To attain the primary object of the present invention, in the shuttle of the present invention, the above-mentioned guide elements comprise lower outside wheels which are rotatably provided on the lower part of the main body and have a rotating axis inclined upwardly and outwardly, respectively, when the shuttle is mounted on the circular loom. Also the outside wheels are supported by said annular guide member in such a manner that said annular guide member bears the force of gravity and the centrifugal force acting on the shuttle when the shuttle is driven by the shuttle propelling mechanism. To attain another object of the present invention, a mechanism for adjusting the length of the connecting lever is provided.

DETAILED DESCRIPTION OF THE PREFERRED EMBODIMENTS

Figure 1:
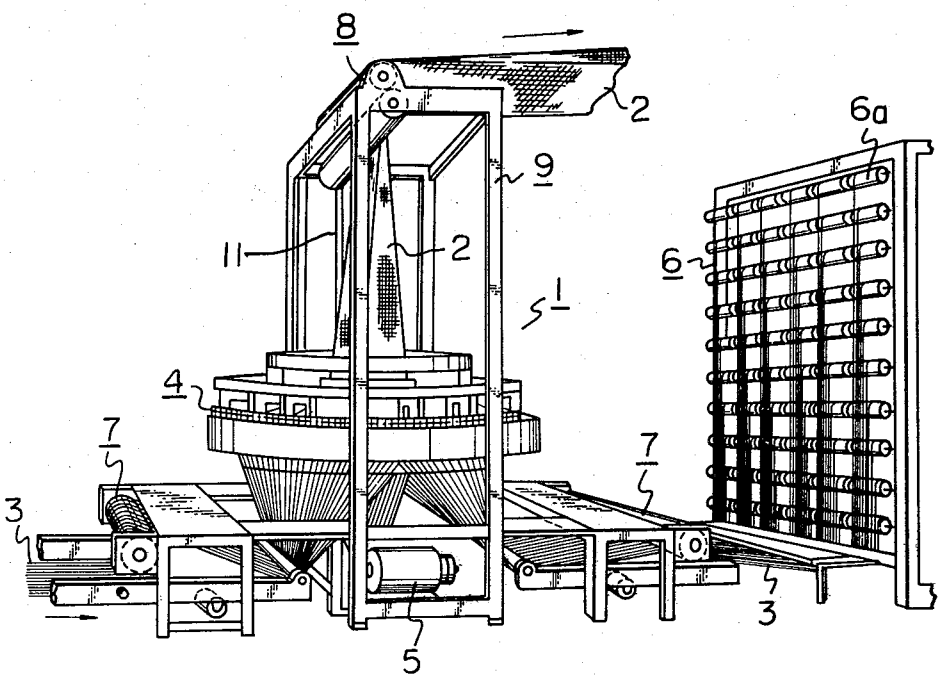
FIG. 1 is a perspective view illustrating one embodiment of a circular loom in which the shuttle of the present invention is utilized.

For the purpose of clearly illustrating the shuttle of the present invention, an embodiment of a circular loom to which the shuttle of the present invention is applied will be described, with reference to FIGS. 1 through 3, prior to entering into the description of the structure and effect of the shuttle of the present invention.

In the circular loom 1 illustrated in FIG. 1, a main part 4 including shed forming means and filling means is mounted within a frame 9, and the shed forming means and filing means are driven by an electric motor 5 disposed below the main part 4 through a first power transmission mechanism (not shown). Tubular fabric take-out means 8 mounted on the frame 9 above the main part 4 is driven by a second transmission mechanism (not shown) connected to the take-out means 8. Since this second power transmission mechanism is driven by the first transmission mechanism through a driving transmission lever 11, the take-out means 8 is driven while being kept synchronous with the main part 4. Warps 3, in a number necessary for weaving a desirable tubular fabric 2, are fed from a plurality of yarn packages 6*a* mounted rotatably on a pair of creels 6, which are disposed on both the sides of the main part 4 symmetrically with each other with respect to the main part 4 (only one creel 6 disposed on the right side is illustrated in FIG. 1). The warps 3 are fed to the main part 4 through warp feed means 7. The tubular fabric 2 formed by the weaving operation in the main part 4 of the circular loom 1 is upwardly taken out by the take-out means 8 and guided to winding means (not shown) in a direction indicated by an arrow.

Figure 2:
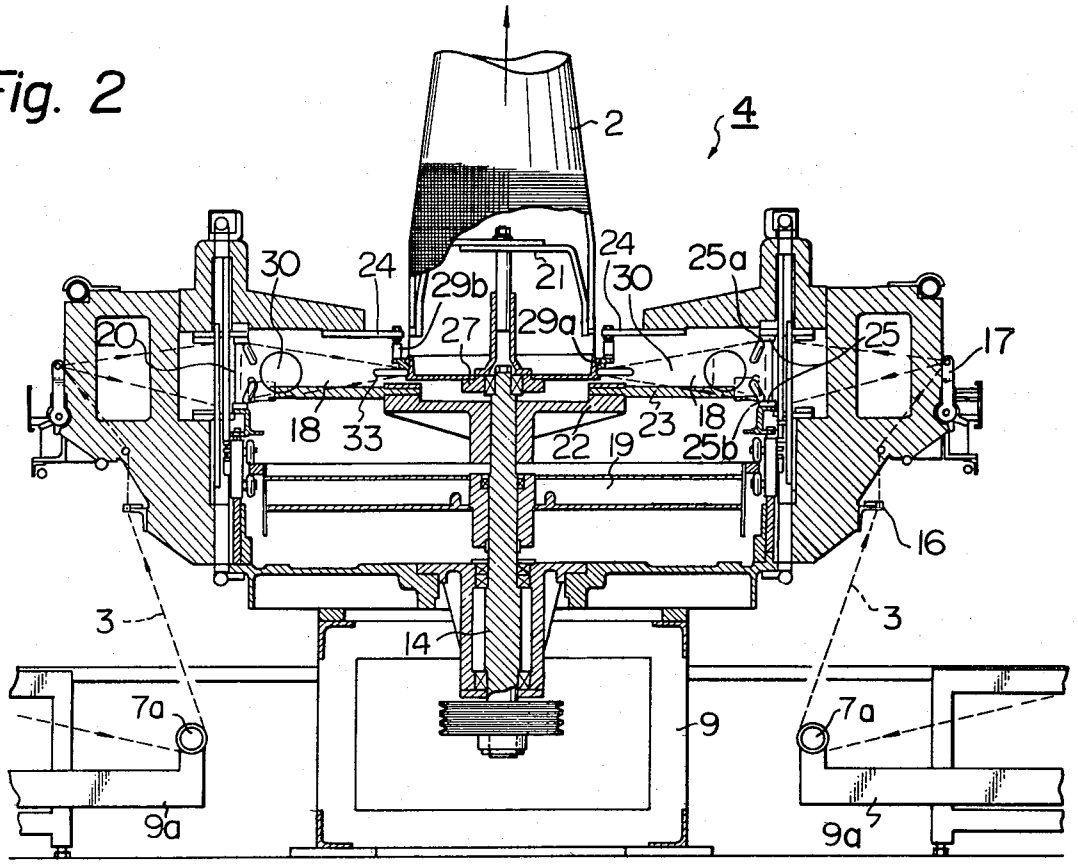
FIG. 2 is a side view illustrating a schematic sectional view of the main part of the circular loom illustrated in FIG. 1.
Figure 3:
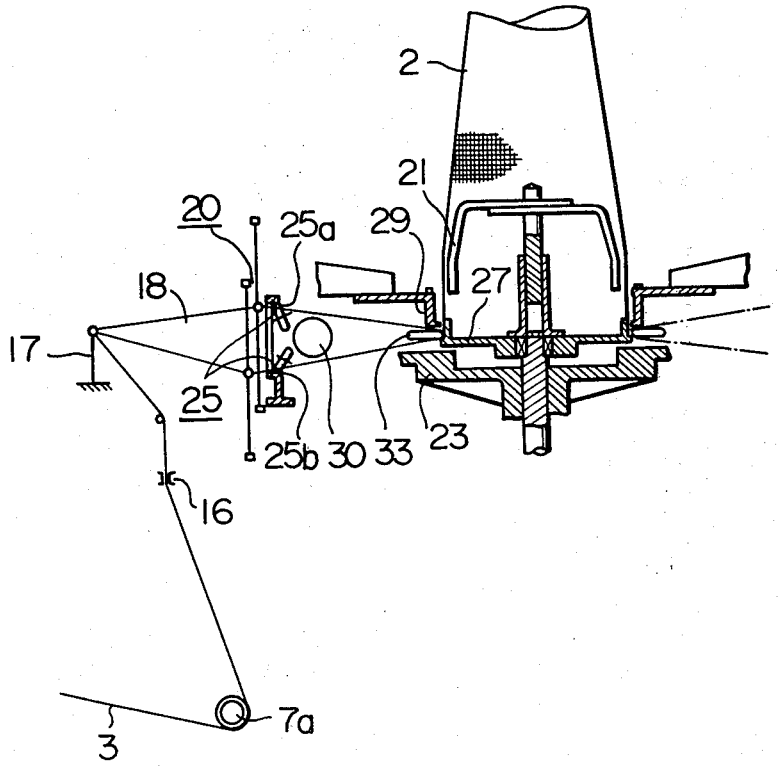
FIG. 3 is a schematic side view of a part of the side view illustrated in FIG. 2.

As illustrated in FIG. 2, the main part 4 of the circular loom 1 comprises: a vertical shaft 14; means for driving the shaft 14; a shed forming mechanism which is driven by a cylindrical cam mechanism 19 mounted on the vertical shaft 14; an annular guide means 25 comprising a pair of annular guide members 25*a*, 25*b* for guiding two pairs of wheels 31*a*, 31*b*; 32*a*, 32*b* (see FIGS. 4, 6 and 8A, 8B) mounted on both sides of a shuttle 30; a horizontal disc guide member 27 supported rotatably on the top of the shaft 14; an inside annular guide means 29 (see FIG. 3) comprising an annular guide member 29*a* which is stationarily held through an intermediate member 29*b* by supporting arms 24, with a slight clearance from the top end of the annular edge of the horizontal disc guide member 27, so as to guide the tubular fabric 2, and; four shuttle propelling mechanisms 23 fixed to a supporting member 22 secured to the shaft 14 at a position above the cam mechanism 19.

As illustrated in the drawings (FIGS. 1, 2 and 3), warps 3 are guided from the creels 6 through guide rolls 7*a* of the feed means 7 rotatably supported on arms 9*a* of the frame 9 and yarn guides 16, to yarn guide apertures formed on the top end portion of a dancing lever 17, and a shed 18 is formed by the shed forming mechanism 20. The shuttle 30 propelled by the shuttle propelling mechanism 23 is inserted in this shed 18 to weave the tubular fabric 2. The tubular fabric 2 is taken out upwardly (in a direction indicated by an arrow in FIG. 2) through an annular clearance formed between the circular edge of the horizontal guide member 27 and the annular guide member 29*a*, while being guided by a fabric guide member 21. Then, the tubular fabric 2 is wound on a roll through the take-out means 8 (FIG. 1) by winding means (not shown).

Each shuttle 30 is provided with an identical structure and function, and therefore, the structure and function of only one of shuttles 30 is hereinafter explained.

Referring to FIGS. 6, 7, 8A and 8B, the shuttle 30 comprises: a main body 35 provided with a pair of brackets 42*a*, 42*b* projected upward from the main body 35; a guide wires 43 extending along the longitudinal direction of the main body 35 at both sides thereof and spaced a uniform distance from the main body 35; a lever 37 pivoted on the top end portion of the main body 35 by a pivot pin 39, and; a connecting lever 38 pivoted on a top end portion of the bracket 42*a* by a pivot pin 44 and connected to the lever 37 by a pivot pin 45. To hold a yarn package 46 formed on a bobbon 47 by the shuttle 30, a pair of gripping members 49 are mounted on the brackets 42*a*, 42*b*, respectively. One of gripping members 49 is capable of displacing into the bracket 42*a*, but is always urged toward the bracket 42*b* by means of a helical expansion spring (not shown) disposed between the bracket 42*a* and the gripping member 49.

In the above-mentioned shuttle 30, another wheel 33 is rotatably mounted on the free end portion of the lever 37. An endless groove is formed on the periphery of the wheel 33 to guide a weft 48 which is taken from the weft yarn package 46 held on the brackets 42*a*, 42*b* of the shuttle 30. The weft yarn 48 is introduced to the guide groove of the wheel 33 through yarn guides 40, 41 mounted on the connecting lever 38, during the movement of the shuttle 30. The shuttle 30 is provided with a roller 50 which is capable of always contacting a part of the shuttle propelling means 23, (see FIGS. 2 and 3) and also an element 51 which is capable of always keeping a breaking action against a bobbin for providing an adequate yarn tension to the weft yarn 48. To attain the purpose of the present invention, particular consideration must be given to the construction of the circular loom in relation to the construction of the shuttle according to the present invention.

Figure 5:
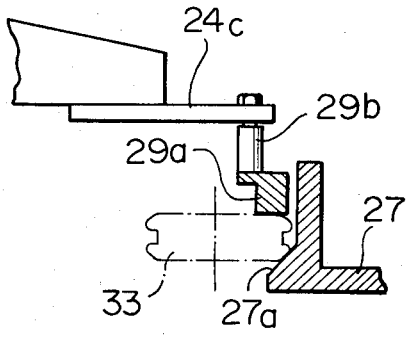
FIG. 5 is an enlarged side view of another part of the mechanism for supporting a running shuttle according to the present invention.
Figure 6:
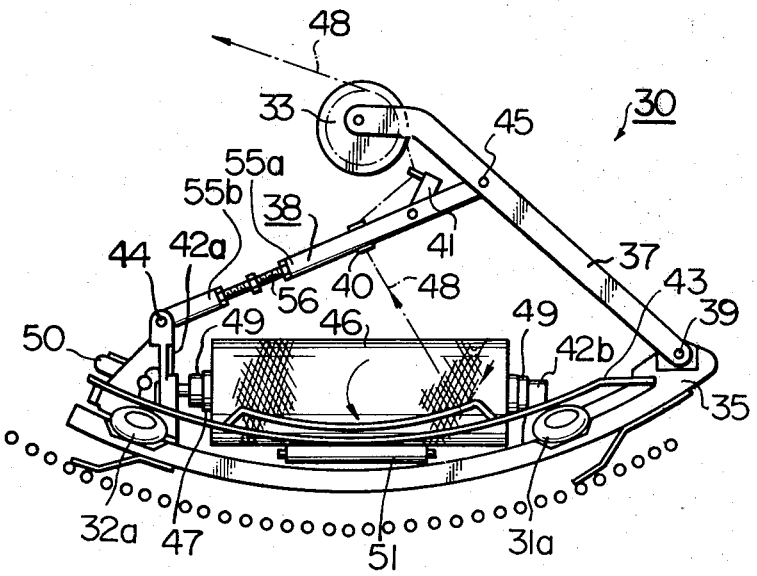
FIG. 6 is a side view of a shuttle according to the present invention.

In the circular loom for which the shuttle of the present invention is utilized, an inside annular guide way is formed by the a bottom surface of the annular guide member 29*a* (see FIG. 5) and the inside annular surface of the horizontal disc guide member 27 (see FIG. 5). This guide way stably guides the wheel 33 (see FIGS. 6, 7 and 8A) of the shuttle 30. As illustrated in FIGS. 3, and 6 when the shuttle 30 is mounted on the circular loom, the shuttle 30 is supported by the above-mentioned inside annular guide way and the annular guide means 25 in such a condition that the lever 37 and the connecting lever 38 are held in a horizontal position. This holding condition is hereinafter referred to as a horizontal condition. To ensure more stable running of the wheel 33 on the inside annular guide way, the inside annular surface of the horizontal disc guide member 27 is provided with an inclined surface 27*a* as illustrated in FIG. 5, and therefore, the above-mentioned inside annular guide way has a similar function to that of a grooved guide way.

Figure 4:
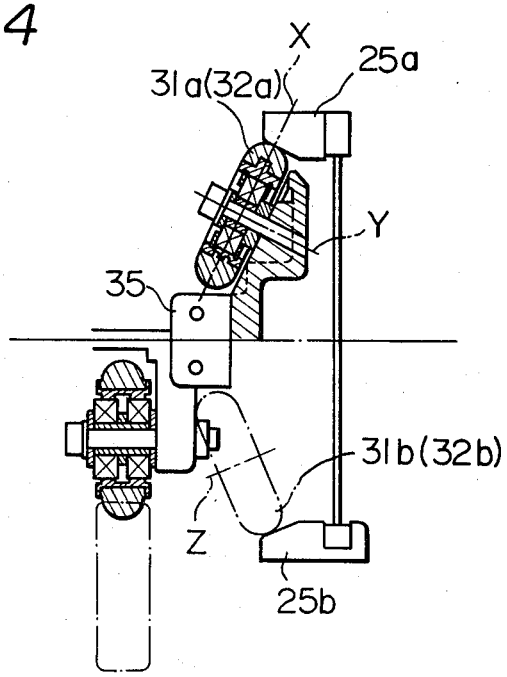
FIG. 4 is an enlarged side view of a part of the mechanism for supporting a running shuttle according to the present invention.

As mentioned above, since the shuttle 30 travels along the annular guide mechanism, that is, the inside annular guide way and the annular guide means 25, in the horizontal condition the condition of mounting the wheels 31*a*, 31*b*; 32*a*, 32*b* (see FIGS. 3, 4 and 8B) on the main body 35 and the shape of the guide members 25*a*, 25*b* of the guide means 25 must be designed so as to attain the stable supporting which is one of the objects of the present invention. Therefore, in the present invention, the guide member 25*a* (hereinafter referred to as an upper guide member) and the guide member 25*b* (hereinafter referred to as a lower guide member) are each provided with inclined annular guide surfaces, as shown in FIG. 4, while the wheels 31*a*, 32*a*, which are capable of contacting the upper guide member 25*a* in a rolling condition, are rotatably mounted on the frame shoe 35 in such condition that, when the shuttle 30 is mounted on the circular loom, the wheels 31*a*, 32*a* occupy the position where the periphery of each wheels 31*a*, 32*a* is capable of smoothly contacting the inclined annular surface of the upper guide member 25*a*. Consequently, plane X passing through the center of the wheels 31*a*, 32*a* and being vertical to the rotating axis Y thereof is preferably perpendicular to the inclined guide surface of the upper guide member 25*a*, as shown in FIG. 4. With regard to the other wheels 31*b*, 32*b*, the same condition as that of the wheels 31*a*, 32*a* exists. Accordingly, when the shuttle 30 is mounted on the circular loom, according to the present invention, the axis Y of each upper wheel 31*a*, 32*a* is arranged in the radial direction and downwardly inclined by a certain angle outwardly with respect to a horizontal plane as shown in FIG. 4. The axis Z of each lower wheel 31*b*, 32*b* is arranged in the radial direction and upwardly inclined by a certain angle outwardly with respect to a horizontal plane as shown in FIG. 4.

In the above-mentioned condition, when the shuttle 30 is propelled by the action of the propelling means 23, centrifugal force is generated. The force of gravity and the centrifugal force acting on the shuttle 30 are supported mainly by the lower wheels 31*b*, 32*b* on the outer end of the shuttle 30. Since the axis Z of each wheel 31*b*, 32*b* is upwardly inclined by a certain angle outwardly with respect to a horizontal plane and the guide surface of the guide member 25*b* is inclined in parallel to the axis Z, the wheels 31*b*, *32b* are capable of bearing the mayority of the force of gravity and the centrifugal force acting on the shuttle 30, while rolling on the guide surface of the guide member 25*b* smoothly and without any trouble. While it is true that a part of the force of gravity acting on the shuttle 30 is borne by the wheel 33 on the inner end of the shuttle 30 and a part of the centrifugal force acting on the shuttle 30 is borne by the upper wheels 31*a*, 32*a* on the outer end of the shuttle 30, the a largest load is imposed on the lower wheels 31*b*, 32*b* disposed on the outer end of the frame shoe 35 of the shuttle 30.

The warps 3 opened to both the upper and lower sides of the shuttle 30 are introduced in the positions between the wheels 31*a*, 32*a*; 31*b*, 32*b* and the guide members 25*a*, 25*b*, and between the wheel 33 and the inside annular guide way, respectively. Therefore, the warps 3 are prevented from being broken by rubbing contact with the shuttle 30.

Various modifications of the above-mentioned embodiment may be effected. The force of gravity and the centrifugal force of the shuttle 30 are mainly supported by the lower wheels 31*b*, 32*b* disposed on the frame shoe 35 of the shuttle 30. Accordingly, the other supporting wheels 31*a*, 32*a*, 33 may be omitted. Since only small loads are imposed on the supporting wheels 31*a*, 32*a*, 33, even if sliders are utilized instead of the supporting wheels 31*a*, 32*a*, 33, and they are slid along the guide members 25*a*, 25*b* and the inside annular guide way, the weaving operation can be performed conveniently without any trouble.

The contacting surface of the annular guide member 25B with which the wheels 31*b*, 32*b* having the inclined axis Z are engaged, need not be inclined as in the above-mentioned embodiment, and various modifications thereof may be effected. For example, in a case where the above-mentioned guide surface of the annular guide member has an L-shaped cross section, the outside wheels are engaged with both sides of the guide surface with an L-shaped cross section.

Figure 7:
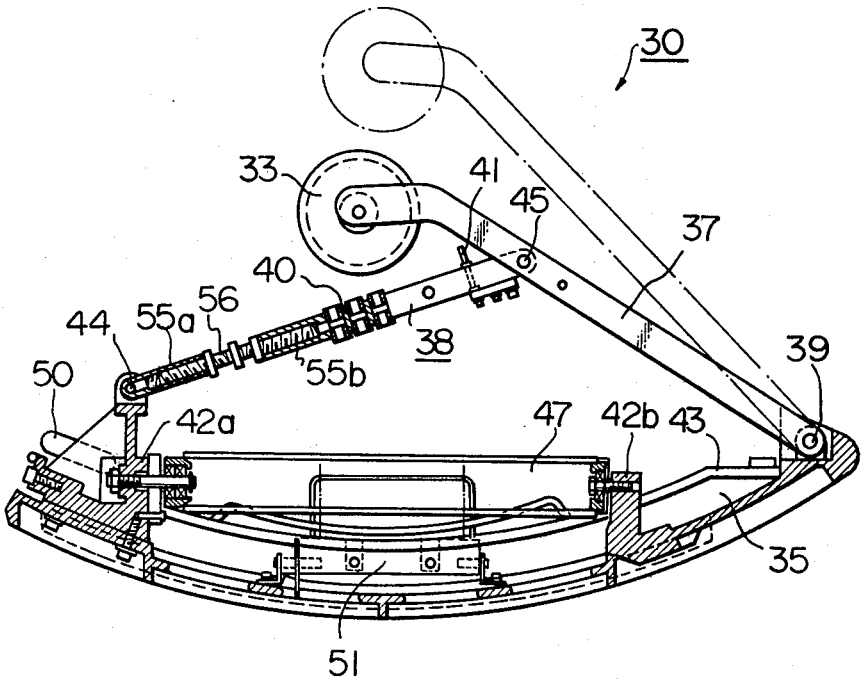
FIG. 7 is a schematic sectional view of the shuttle illustrated in FIG. 6.
Figure 8A:
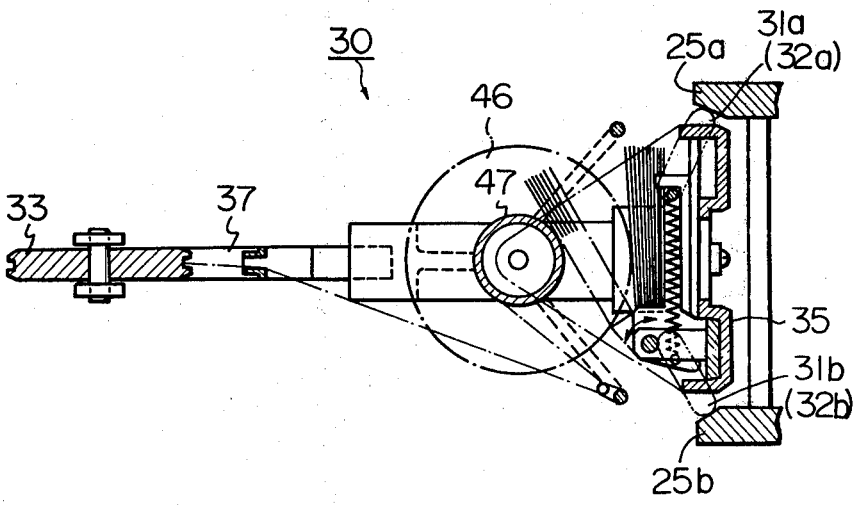
FIG. 8A is a schematic front view of the shuttle illustrated in FIG. 6.
Figure 8B:
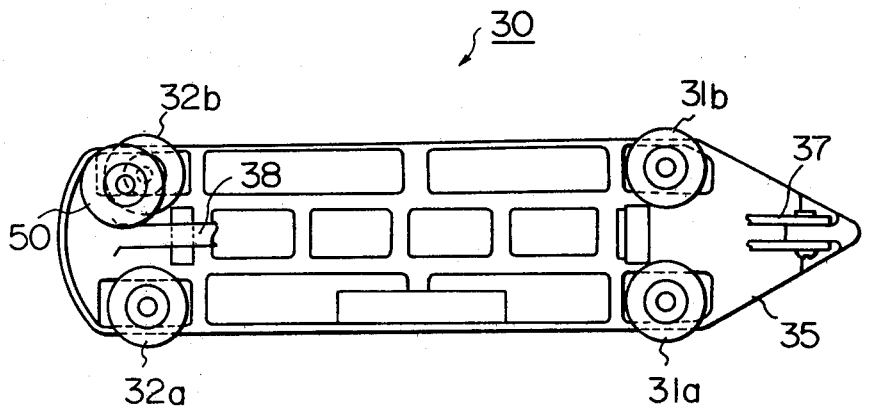
FIG. 8B is a partly omitted schematic plan view of the shuttle illustrated in FIG. 6.

To attain another object of the present invention, in the shuttle according to the present invention, a connecting lever 38 having an adjustable length is utilized. An embodiment of the adjustable connecting lever 38 is illustrated in FIGS. 6 and 7. The connecting lever 38 included a turn buckle, that is, the connecting lever 38 comprises a pair of sleeves 55*a*, 55*b* provided with threaded inner cylindrical surfaces, respectively, wherein the spiral directions of the threads are opposite to each other, and a bolt 56 having both threaded end portions engaged into the sleeves 55*a*, 55*b*, respectively. As illustrated in FIG. 7, the sleeve 55*a* is pivotably connected to the top end portion of the bracket 42*a* by the pivot pin 44, while the sleeve 55*b* is pivotably connected to the lever 37 by the pivot pin 45. Accordingly, the length of the connecting lever 38 can be elongated or shortened by turning the bolt 56.

In the circular loom utilizing the shuttle having the above-mentioned structure, when it is necessary to take out the shuttle 30 from the loom, because the shuttle was destroyed by some accident or an operational condition must be changed, such as a changing of a fabric width, the bolt 56 is turned to shorten the length of the connecting lever 38. The lever 37 is turned about the pivot pin 39, at the front end of the frame shoe 35 in the counterclockwise direction in FIG. 6 when the length of the connecting lever 38 is shortened. This causes the wheel 33 on the inner end of the shuttle 30 mounted on the circular loom to be displaced outwardly in the radial direction of the circular loom 1, that is, toward the frame shoe 35 of the shuttle 30 and drawn out from between the inner annular guide way formed by the horizontal disc guide member 27 and the annular guide member 29. Accordingly, the shuttle 30 can easily be dismounted from the annular guide means 25 and the above-mentioned annular guide way.

When it is required to mount a shuttle 30 having the above-mentioned structure on the circular loom 1 illustrated in FIGS. 1 through 5, in the state where the length of the connecting lever 38 is shortened, the wheels 31*a*, 32*a*; 31*b*, 32*b* disposed on the frame shoe 35 of the shuttle 30 are firstly engaged with the annular guide members 25*a*, 25*b*, respectively. The lever 37 is turned in the clockwise direction in FIG. 6 by turning the bolt 56 so that the length of the connecting lever 38 is elongated. Accordingly, the wheel 33 of the shuttle 30 is displaced inwardly in the radial direction of the circular loom 1, and is inserted into the inner annular guide way formed between the horizontal disc guide member 27 and the annular guide member 29 until it is in contact with the above mentioned members. Accordingly, the shuttle 30 can stably be supported by the above-mentioned inner annular guide way and the annular guide members 25*a*, 25*b*, since a stable triangle is formed by the three points consisting of the connection point between the lever 37 and the connecting lever 38, and the pivot pins 39 and 44 of the shuttle 30.

Incidentally, if the lever 37 is separably connected to the connecting lever 38 when it is required to mount the shuttle 30 on the circular loom, the lever 37 can be turned by separating the lever 37 from the connecting lever 38. However, if a mechanism for elongating the shortening the length of the connecting lever 38 is not adopted, the position of the wheel 33 cannot be minutely adjusted when the shuttle 30 is supported. Accordingly, it is preferred that both a lever 37 separably connected to the connecting lever 38 and a mechanism for elongating and shortening the length of the connecting lever 38 be adopted simultaneously. With regard to the mechanism for providing the function of adjusting the length of the connecting lever 38, any known mechanism, such as a mechanism utilized for adjusting the lengths of the legs of a tripod supporting a camera, can be satisfactorily applied to the shuttle according to the present invention. As mentioned above, since the lever to which the inner wheel 33 is disposed is connected to the telescopic connecting lever which can be elongated or to shortened displace the wheel 33, the shuttle 30 can easily be mounted in the circular loom, so that the shuttle can stably be supported by the inside annular guide way and the outside annular guide members and the primary object of the present invention effectively attained.

I claim:

1. A shuttle for weaving a tubular fabric on a circular loom provided with (i) means for guiding said shuttle during the weaving operation, (ii) means for propelling said shuttle along said guiding means, said guiding means comprising an outside annular guide member having a ring shaped guide surface provided with a center axis identical to a central axis of said circular loom and an inside annular guide way concentrically formed about a central axis of said circular loom, said shuttle comprising:

a main body of the shuttle;

a pair of brackets projected from said main body toward the inside of said shuttle;

a first lever rotatably mounted on a first pivot pin at a forward end portion of said main body;

a connecting lever rotatably mounted on one of said brackets located at a rear side of said main body by means of a second pivot pin, said connecting lever being pivoted to said first lever;

an inside guide wheel rotatably mounted on said first lever at a position where said inside guide wheel is capable of engaging with said inside annular guide way when said shuttle is mounted on said circular loom;

guide elements comprising lower outside wheels rotatably provided on a lower part of said main body, each of said outside wheels having a rotating axis inclined upwardly and outwardly when said shuttle is mounted on said circular loom, said outside wheels being supported by said annular guide member in such a manner that said annular guide member bears the force of gravity and the centrifugal force acting on said shuttle when said shuttle is driven by said shuttle propelling mechanism; and means for holding a bobbin at a position between said brackets and guide elements and capable of smoothly contacting said annular guide member and inside annular guide way.

2. A shuttle according to claim 1, wherein said axes of said outside wheels are parallel to said ring shaped guide surface of said annular guide member inclined inwardly.

3. A shuttle according to claim 1, further comprising upper outside wheels rotatably provided on upper parts of main body, said upper outside wheels being contact with another outside annular guide member of the circular loom.

4. A shuttle according to claim 1, wherein the lower and upper outside wheels are respectively urged to the corresponding outside annular guide members.

5. A shuttle according to claim 1, wherein said second lever is provided with a mechanism for changing the length thereof.

6. A shuttle according to claim 5, wherein said mechanism is a turnbuckle.

* * * * *